US008365781B2

(12) United States Patent
Stenstrom

(10) Patent No.: US 8,365,781 B2
(45) Date of Patent: Feb. 5, 2013

(54) METHOD OF MANUFACTURING EDGE GLUED LAMINATED PANELS AND EDGE GLUED LAMINATED PANELS MANUFACTURED ACCORDING TO SAID METHOD

(75) Inventor: Lars Stenstrom, Nyland (SE)

(73) Assignee: SCA Forest Products AB, Sundsvall (SE)

( * ) Notice: Subject to any disclaimer, the term of this patent is extended or adjusted under 35 U.S.C. 154(b) by 312 days.

(21) Appl. No.: 12/667,730

(22) PCT Filed: Jul. 9, 2007

(86) PCT No.: PCT/SE2007/050516

§ 371 (c)(1),
(2), (4) Date: Apr. 13, 2010

(87) PCT Pub. No.: WO2009/008791

PCT Pub. Date: Jan. 15, 2009

(65) Prior Publication Data

US 2011/0014413 A1 Jan. 20, 2011

(51) Int. Cl.
*B27F 1/00* (2006.01)

(52) U.S. Cl. ..... 144/345; 144/363; 144/360; 144/402; 144/416

(58) Field of Classification Search ..... 144/345, 144/346, 348, 359, 360, 363, 364, 376, 377, 144/380, 387, 389, 392, 402, 403, 410, 416, 144/391

See application file for complete search history.

(56) References Cited

U.S. PATENT DOCUMENTS

| | | | | |
|---|---|---|---|---|
| 2,117,641 A | | 5/1938 | Westlund | |
| 3,993,426 A | * | 11/1976 | Ahrweiler et al. | 425/371 |
| 4,118,268 A | * | 10/1978 | Price | 156/510 |
| 4,611,646 A | | 9/1986 | Wassmer et al. | |
| 4,762,157 A | | 8/1988 | Andersson | |
| 4,818,321 A | * | 4/1989 | Shimizu et al. | 156/254 |

(Continued)

FOREIGN PATENT DOCUMENTS

| | | |
|---|---|---|
| CA | 2 443 448 A1 | 1/2003 |
| DE | 10 201 343 A1 | 7/2003 |

(Continued)

OTHER PUBLICATIONS

Merriam-Webster online dictionary 2010. Definition for term "rest".*

(Continued)

*Primary Examiner* — Bena Miller
(74) *Attorney, Agent, or Firm* — Young & Thompson

(57) ABSTRACT

An improved method and arrangement for increasing the yield in the production of edge glued laminations for the manufacture of edge glued laminated panels from thin timber. The edge glued laminations are manufactured from planed boards with residual waney edge by longitudinal sawing on an edging line including an upper and lower inlet feed conveyor, and edging machine and an upper and lower outlet feed conveyor, the edging machine preferably including a number of saw blades which are laterally adjustable, and the feed conveyors including endless belts of reinforced rubber 5-10 mm thick, having an underside provided with longitudinal channels with a width of 2-10 mm and a depth of 2-10 mm, the feed conveyors running on a number of tracked rollers adapted to the belts. An edge glued laminated panel based on varying lamination widths manufactured according to the method is also described.

10 Claims, 5 Drawing Sheets

U.S. PATENT DOCUMENTS

| | | | | |
|---|---|---|---|---|
| 5,135,597 | A * | 8/1992 | Barker | 156/264 |
| 5,351,731 | A * | 10/1994 | Brandt et al. | 144/352 |
| 5,881,786 | A * | 3/1999 | Wilderman et al. | 144/348 |
| 6,701,984 | B2 * | 3/2004 | Lamontagne et al. | 144/347 |
| 2002/0000148 | A1 | 1/2002 | Brun | |
| 2004/0040625 | A1 * | 3/2004 | Knokey et al. | 144/347 |
| 2006/0048852 | A1 * | 3/2006 | McIntosh | 144/380 |

FOREIGN PATENT DOCUMENTS

| | | | |
|---|---|---|---|
| EP | 1 287 955 | A2 | 3/2003 |
| EP | 1 862 276 | A1 | 12/2007 |
| SE | 515660 | C2 | 9/2001 |
| SE | 525081 | C2 | 11/2004 |
| WO | WO 98/30370 | A1 | 7/1998 |
| WO | WO 9926768 | A1 * | 6/1999 |

OTHER PUBLICATIONS

International Search Report, dated Oct. 16, 2008, from corresponding PCT application.

* cited by examiner

METHOD OF MANUFACTURING EDGE GLUED LAMINATED PANELS AND EDGE GLUED LAMINATED PANELS MANUFACTURED ACCORDING TO SAID METHOD

TECHNICAL FIELD

The present invention relates to a method of manufacturing edge glued laminated panels, preferably of timber, and edge glued laminated panels manufactured according to the method.

The manufacture of edge glued laminated panels represents a known technology that has long been in widespread use. The term edge glued laminated panels in this context relates to panels, preferably of timber material, which have been manufactured by gluing a number of laminations together widthways into larger panels. The laminations in question are known as edge glued laminations and usually have a width of 20-100 mm and a thickness of 10-50 mm. In this way it is possible, from wood of relatively small dimensions, to manufacture high-quality timber panels with widths of up to 1000 mm and more.

PRIOR ART

The starting point in the conventional manufacturing process for the production of glue-laminated panels is usually sawn wood with a rectangular cross section of thicker dimensions from timber with a diameter of 200-400 mm, which after drying to 8-12% is planed to a specific thickness in the conventional way. The piece of wood is then sawn up into a number of identical edge glued laminations, which are then joined together to form a panel by gluing sawn laminations together on the previously planed surfaces. The other surfaces of the edge glued laminated panels are then finished through further processing and grading to obtain the required product.

Another known technique, mostly used on thin timber with a diameter of less than 200 mm is first to saw though the log in completely parallel sections, so that a number of pieces of wood with an identical thickness of 10-50 mm and naturally irregular edges is obtained. Before or after drying to 8-12% these pieces of wood are then edge-sawn into laminations with incrementally equal widths of 30-100 mm, which are sorted according to width before being further machined into rectangular laminations and glued together to form edge glued laminated panels.

Obtaining high-quality edge glued laminated panels places great demands on the edge glued laminations. On the one hand there is a need for a high surface regularity of the surfaces that are to be glued together, and on the other only very small tolerances are permitted in respect of the right angles of the laminations. This is conventionally achieved by planing a number of section surfaces, as described above, at right angles and to the required surface regularity. Using this technique, edge glued laminations of just one width or possibly a few widths are desirable. Requirements are also very exacting with regard to careful handling of the edge glued laminations throughout the entire manufacturing process, or in the output from or conveying between different processing stages, so as not to damage surfaces and edges of the laminations.

PROBLEM

The manufacture of edge glued laminated panels by the conventional technique has a number of disadvantages. Raw timber material of relatively thick diameter, more than 200 mm, is normally required in order to yield an economically viable result. On a commercial scale, the rate of processing must be so high that only the production of laminations of identical width and planed gluing surface has hitherto been feasible. For the process to be commercially viable, however, the aim should be to use thin timber with small log diameters, which besides being relatively cheap compared to thicker timber also affords a lower rate of quality rejection on the grounds of natural defects in the wood, such as loose knots and resin pockets.

Using thin timber with a diameter of less than 150 mm, the known technique instead gives a relatively poor wood yield from the raw material. Among other things, each machining stage produces yield losses, and the process very often also fails to exploit the natural taper of the lock, resulting in material wastage.

There has therefore long been a desire to improve the wood yield in the manufacture of edge glued laminated panels, and there is a potential for an improvement of up to 40% if the wastage in the process can be minimized. An improved wood yield from thin timber by the conventional technique, however, dictates that edge glued laminations of several widths must be usable in the process, in order to exploit the irregular shape and taper of the log. These factors are shown schematically in FIG. 1 and FIG. 2. At the same time it is desirable in other parts of the process to keep the number of lamination widths to a minimum. In order to obtain the requisite surface regularity at the edges of the edge glued laminations that are to be glued, however, the process has hitherto demanded planing of these edges. The planing requirement is in turn the factor which limits the use of several different lamination widths, since no planes are available with a rapid and continuously variable width adjustment. The sawing technology hitherto available has been incapable of replacing the planing, since it has not proved to give sufficiently satisfactory results in combination with a line speed of over 100 m/min, which is necessary in order to make this type of production sufficiently profitable. One of the requirements, if the sawing technology is to be capable of achieving the necessary surface regularity and rectangularity of the laminations, is that the boards can be held fixed with great precision whilst at the same time fulfilling the requirements for careful handling described earlier.

SUMMARY OF THE INVENTION

According to the invention the problems associated with earlier methods of producing edge glued laminations are solved by a method of manufacturing edge glued laminations for the manufacture of edge glued laminated panels from thin timber derived from logs that are sawn through in parallel sections to form pieces of wood, following which said pieces of wood, after drying, are planed even and cut longitudinally to form lamination pieces, following which each lamination piece is gauged in continuous production and is fed with great precision between feed conveyors through a flexibly adjustable edge sawing machine, the width adjustment of which is controlled and optimized by said gauging result, and that the lamination piece is then sawn into edge glued laminations of optimum width. A distinctive feature of the method is that the feed conveyors consist of endless belts of reinforced rubber 5-15 mm thick, which fix the lamination piece laterally, and that these feed conveyors rest on idler or drive rollers along the entire conveying length, and that these feed conveyors on the side remote from the lamination pieces have a number of longitudinal channels and that the idler or drive rollers are provided with circumferential surfaces having tracks which correspond to the channels and in which the feed conveyors run.

A primary object of the present invention is therefore to provide an improved method and arrangement for increasing the yield in the production of edge glued laminations for the manufacture edge glued laminated panels from thin timber, whilst at the same time necessarily fulfilling the requirements for careful handling of the laminations. In order to achieve this object, the process proceeds from logs which are sawn through in parallel sections, following which the pieces of wood, after drying, are planed even and cut longitudinally to form lamination pieces in lengths which are as close as possible to that of the end product, following which they are edge sawn so as to utilize the maximum volume of the individual lamination piece. Each lamination piece is then gauged in continuous production and is fed with great precision through a flexibly adjustable edge sawing machine, the width adjustment of which is controlled and optimized by the gauging result. FIG. 3 shows a schematic diagram of an edging line. FIG. 4 shows a schematic diagram of a gauging system for continuous production.

So as not to exceed the maximum permitted lamination width, the saw with multiple, parallel saw blades is capable of producing more than one lamination widthways from each lamination piece, the interval between at least two saw blades being variable so that it can adjust itself to the optimum cutting position for each individual lamination piece. FIG. 6 shows a schematic illustration of how the saw blades can be arranged.

In order to be able to feed relatively short wood pieces through a gauging system with great precision and at high speed, and then through edging blades whilst maintaining he positional control, the conveyor elements are comprised of feed conveyors which press the lamination piece firmly both from above and from below, so that it is fed quite straight and its alignment is not affected by the cutting tools. The feed conveyors preferably comprise endless belts of reinforced rubber 5-15 mm thick, which enclose the lamination piece with a pressure such that the contact friction is high. These belts rest on idler or drive rollers along the entire conveying length and on the side remote from the lamination pieces have a number of channels. The idler or drive rollers are provided with tracked circumferential surfaces which correspond to the channels and in which the feed conveyors run, so that the belts are securely fixed laterally. Said longitudinal channels and circumferential surfaces may have a V-shaped, rectangular or other cross section and have a width of 2-10 mm and a depth of 2-10 mm. FIG. 10 shows a schematic illustration of a cross section of such a feed conveyor. At the machining blade tools, the conveyor system has as brief an interruption as is technically feasible. FIG. 7 shows an example of how this can be achieved. The system with support rollers also prevents the belts absorbing too much frictional heat from the underlying surface. After sawing, the belts convey the wood onwards to a downstream edge strip separator, which means that the right-angled laminations are automatically separated from the trimmed edges. FIG. 12 shows an example of how such an edge strip separator may be designed.

An edge glued laminated panel according to the invention is therefore based on edge glued laminations of varying width produced from thin timber, the process proceeding from logs which are sawn through in parallel sections to form pieces of wood, following which the pieces of wood, after drying, are planed even and cut longitudinally to form lamination pieces. Each lamination piece is gauged in continuous production and is fed with great precision between feed conveyors through a flexibly adjustable edge sawing machine, the width adjustment of which is controlled and optimized by said gauging result, and the lamination piece then being sawn into edge glued laminations of optimum width.

BRIEF DESCRIPTION OF THE DRAWINGS

The invention will be described in more detail below with reference to the figures shown in the drawings attached, of which.

PREFERRED EMBODIMENT

Figure 1:
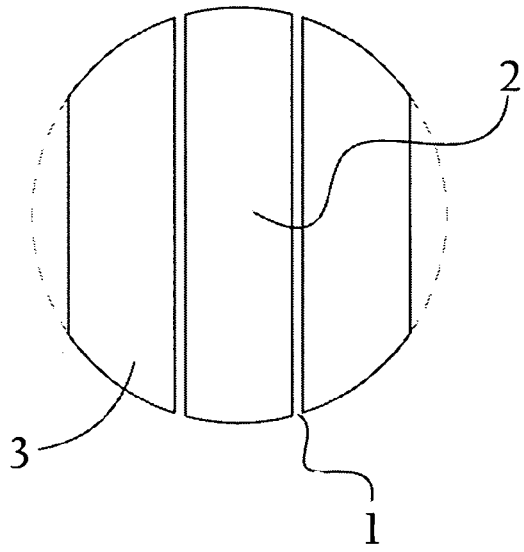
FIG. 1 shows a schematic diagram indicating how the lamination pieces can be sawn from a log.
Figure 2:
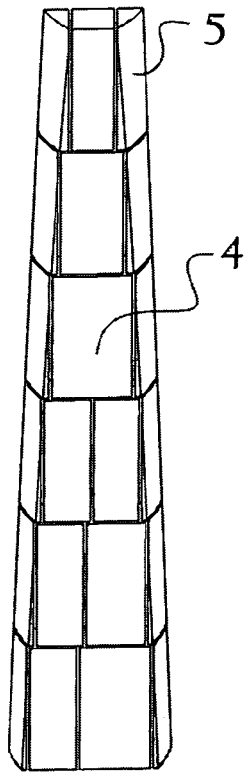
FIG. 2 shows a schematic diagram indicating how the taper of the log affects the yield from the log.
Figure 3:
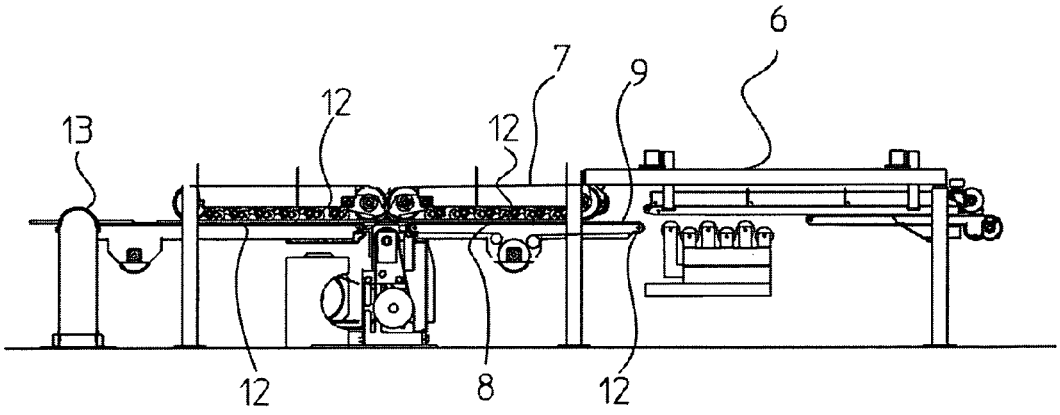
FIG. 3 shows a schematic diagram of the production line from feeding in of the lamination piece to the separation of edge strips.
Figure 4:
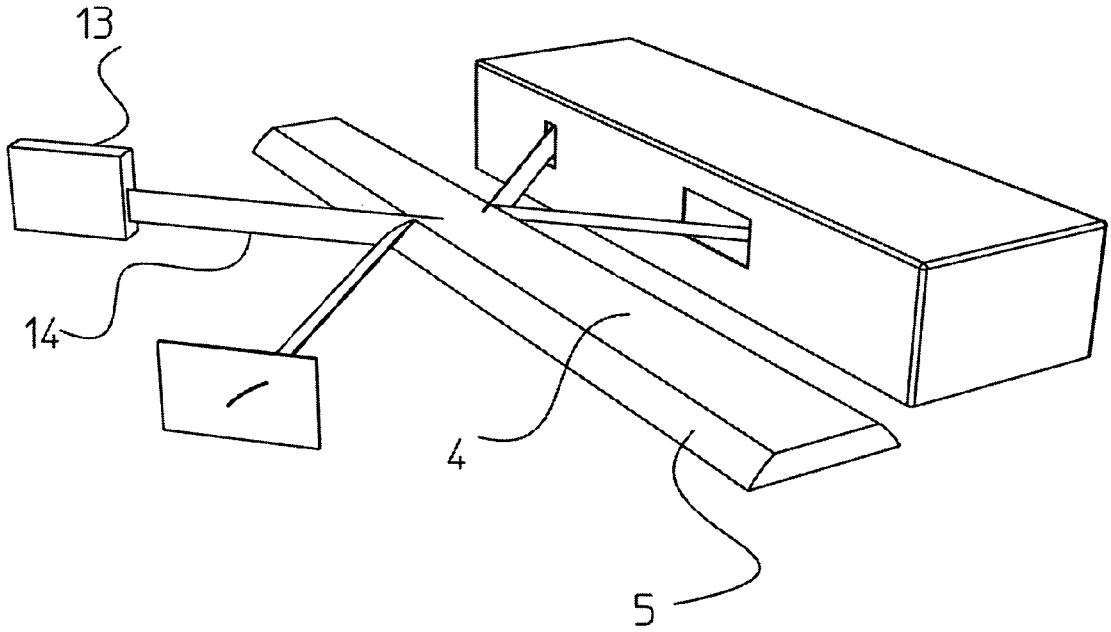
FIG. 4 shows a schematic illustration of the lamination piece gauging system before the edging line.
Figure 5:
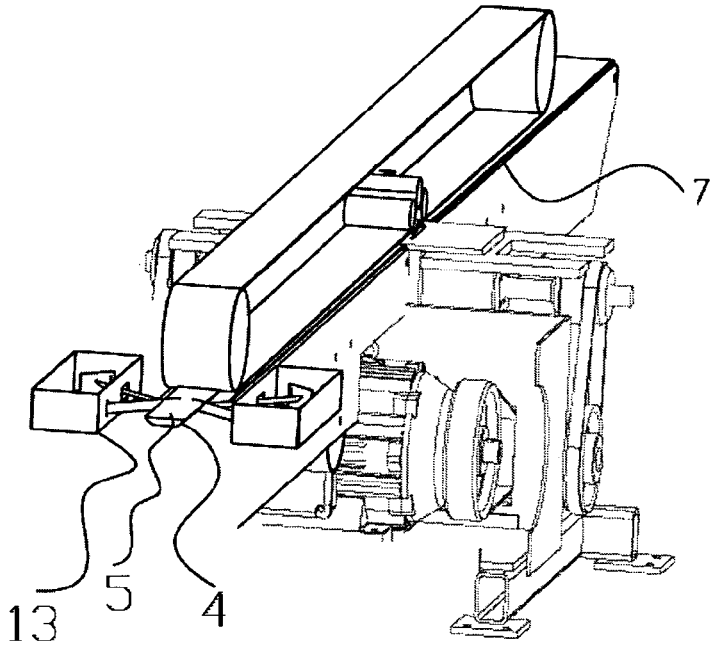
FIG. 5 shows a schematic illustration indicating how the lamination pieces are conveyed to the edging machine during gauging.
Figure 6:
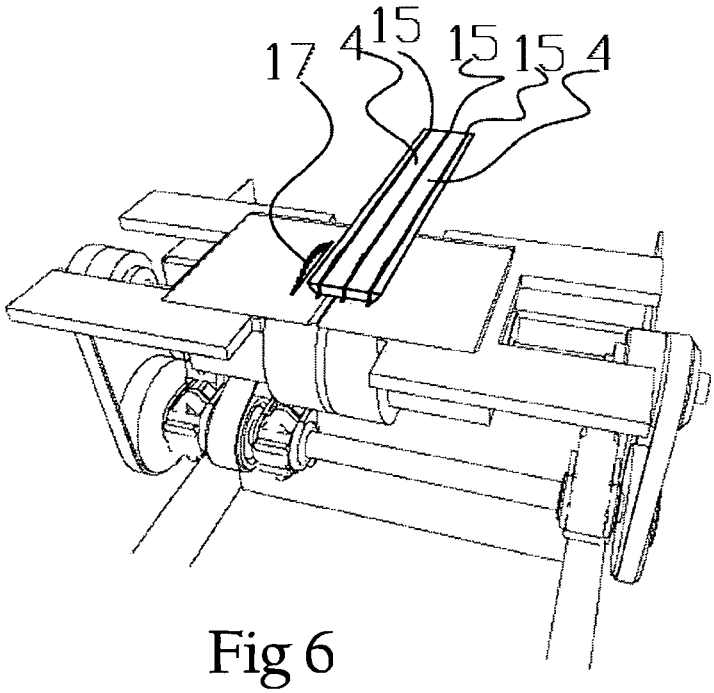
FIG. 6 shows a schematic illustration of the saw blades in the edging machine.
Figure 7:
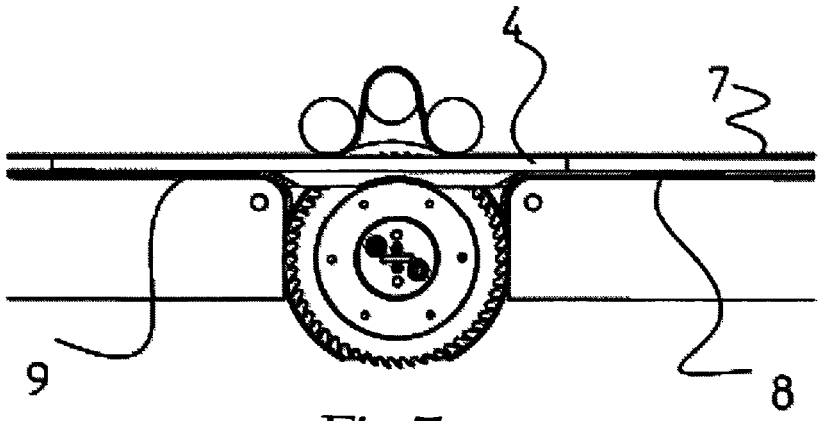
FIG. 7 shows a side view of the edging machine with saw blades and feed conveyors.
Figure 8:
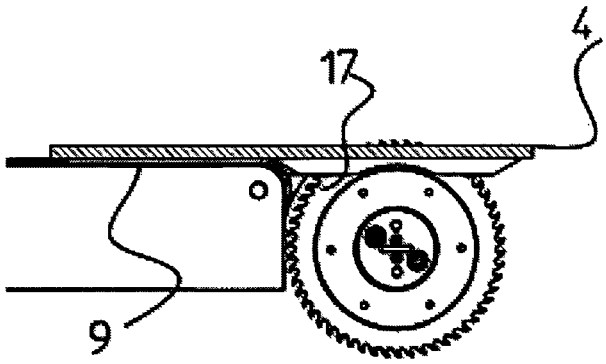
FIG. 8 shows a schematic illustration of the feed conveyors.
Figure 9:
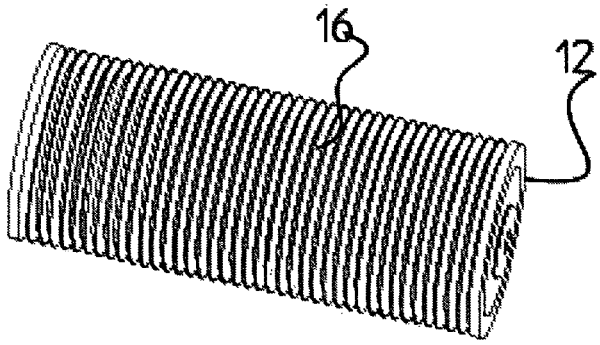
FIG. 9 shows an exemplary embodiment of a tracked roller for the feed conveyor.
Figure 10:
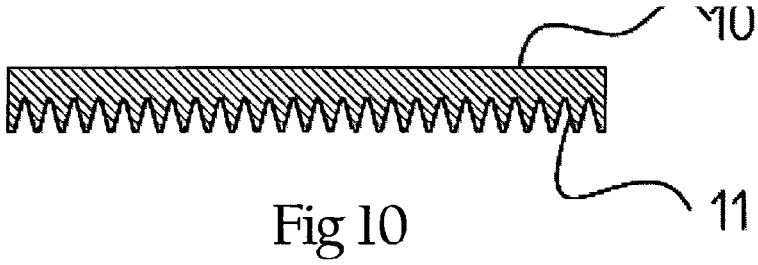
FIG. 10 shows a schematic diagram of a feed conveyor in cross section.
Figure 11:
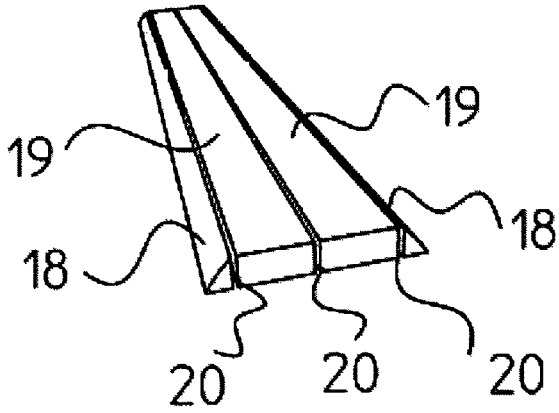
FIG. 11 shows a schematic diagram of a sawn lamination piece.
Figure 12:
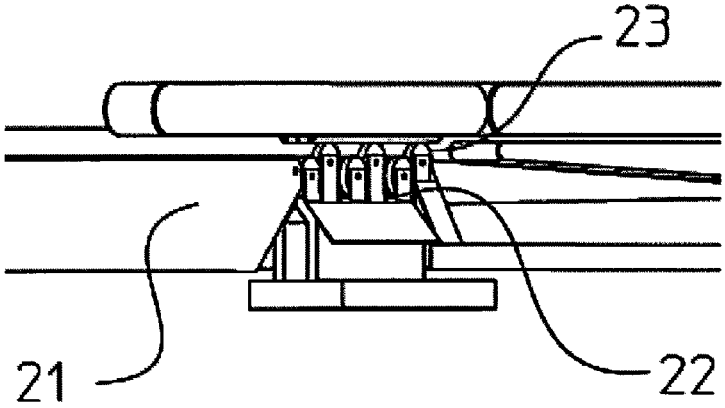
FIG. 12 shows a schematic diagram of one type of edge strip separator.

In a preferred embodiment for the production of glue laminated panels the method proceeds from relatively thin timber of preferably bare wood having a top diameter of 80-140 mm, which has been cut to logs 2 with a length of 3.5-5.1 m. The exact set length of the logs must be adjusted according to the length of the end product, so as to make maximum use of the raw material. In the example, set lengths of 3.5 m, 4.3 m and 5.1 m have been selected. The taper of the timber of sawn dimensions may be assumed to be approximately 11 mm/m. In cutting up the log 2, larger root members must be milled away. The logs are sawn through in parallel sections 1 without edging to wood 3 with a thickness of approximately 20 mm and a total width preferably greater than 80 mm. After sawing, the wood 3 must be spread for drying to a moisture content of approximately 8% in the conventional way.

After drying, the wood must first be planed and then cut to form lamination pieces 4 with a length of approximately 900 mm but retaining the waney edge 5. This is done by conventional techniques. The drying process gives rise to cupping and irregular thickness of the wood, for which reason the object in planing is to create a plane reference surface and an even thickness, against which the edging can be performed at right angles. The rate of feed is normally about 150 m/min.

After planing, the boards are fed by cross conveying through a multi-blade, adjustable crosscut saw and cut to lamination pieces 4 minimally over-dimensioned in relation to the length of the end product. Passing through the crosscut saw, the boards are fastened by firmly clamping them between underlying and overlying driven belts, since they have altogether irregular edges and cannot be fed in the conventional way with parallel drive rows.

After cutting, the lamination pieces continue on a belt table. On the belt table lamination pieces are separated into two lines. In this way two parallel flows of lamination pieces are created with a gap equal to approximately one length between them, before being delivered to the next stage in the process.

For the next stage of the process, therefore, there are two parallel edging lines 6 of the type described below. Since each lamination piece must be edged with an individual width, the process requires an interval between the pieces so that saw blades 17 in the edging lines can be moved to a new optimum position between the pieces. A typical feed rate is 150 m/min.

In the edging lines 6, the lamination pieces 4 are sawn to right-angled edge glued laminations of the desired width and surface regularity. The lamination pieces 4 come to each edging line in rows, centered about their center line and with a gap of about one board length. In this position the lamination pieces 4 are firmly pressed between an upper endless feed conveyor 7 and a lower endless feed conveyor 8, affording high friction and lateral stability and situated in front of the edging machine. These feed conveyors 7, 8 are of poly-V type and have a width of 200 mm and are made of 10 mm-thick rubber 10, and according to the invention are designed with an underside and an upper side provided with longitudinal channels 11 having a width of 5 mm and a depth of 5 mm. The channels 11 may take different forms, having a V-shaped, embodiment is a V-shaped cross section. The feed conveyors run on 200 mm wide tracked rollers 12 with channels 16 corresponding to the belts. Belts of this type are available on the market, for example, under the name Poly-V belt PL 5029-40 from the manufacturer JensS. In front of the edging machine a camera system 13 gauges the waney edge shape 5 from both sides. Such cameras are available on the market, for example, from the manufacturer Sick-IVP. Laser beams 14 form sharp contour lines on the advancing wood, and these contour lines are read off by high-resolution cameras with a very high image frequency. On the basis of the gauging result from the laser beams 14, software adapted to this purpose can rapidly calculate where the sawn sections 15 are to be laid in order to optimize the width yield of the sharp edged, edge glued laminations. In this embodiment the lamination widths should be between 30 and 100 mm. The lower surface constitutes a reference for the saw cuts, and the lamination pieces 4 are therefore pressed against the lower belt.

The edging machine comprises four saw blades 17, which are mounted in pairs at an interval of approximately 50 mm from one another. Each pair can be continuously positioned according to input data from the gauging system. A suitable diameter of the saw blades 17 is 300-450 mm with 60-100 teeth and a tooth width of 2.5-4.0 mm on a 2.0 to 2.5 mm stem. For a cutting rate of 100 m/sec, the speed should be approximately 5000 rpm, which allows a feed rate for the lamination pieces 4 of 150 m/min. A common motor for all saw blades 17 is preferable, in order to reduce the risk of cross-dragging. The width adjustment of the blades is achieved by means of linear motors having few moving parts and great speed and precision. Depending on the width of the unedged lamination piece, the control system above elects to make between one and three useable laminations widthways out of one and the same piece. Since at least one of these laminations may have any width, the overall potential of the piece can be utilized to the full.

After sawing, the finished laminations are held in place by a corresponding feed conveyor 9, which is situated downstream of the edging machine.

After sawing, the unwanted edge strips 18 are separated from the finished edge-glued laminations 19. The earlier control system registers where the previous saw cuts are located and in the downstream edge strip separator 21 can adjust the positioning of the three parallel rows 22 of longitudinal wheels 23 or other arrangements, which lift the usable edge glued laminations 19 to a somewhat higher conveying level, minus the unwanted edge strips 18, which subsequently drop onto an underlying conveyor system as by-products.

In a conventional process downstream, the edge glued laminations are glued together to form finished edge glued laminated panels, which can then be fine-sanded and surface-treated in order to obtain an end product having the desired characteristics. This handling is done by conventional wood processing systems.

The invention claimed is:

1. Arrangement for manufacturing edge glued laminations for the manufacture of edge glued laminated panels from thin timber logs, the arrangement comprising:

a first saw for sawing the logs through in parallel sections to form pieces of wood, a drying section for drying the pieces of wood, a planing section, and a cutting section for longitudinally cutting the pieces of wood to form lamination pieces (4), said cutting section being followed by:

a gauging system for continuously gauging each lamination piece and obtaining a gauging result, a feeding section comprising endless feed conveyors (7, 8, 9) of reinforced rubber 5-15 mm thick, which are arranged to fix the lamination pieces (4) laterally, the feed conveyors (7, 8, 9) resting on idler or drive rollers (12) along an entire length of the feed conveyors, the feed conveyors (7, 8, 9) having a number of longitudinal channels (11) on the side remote from the lamination pieces (4), the idler or drive rollers (12) being provided with circumferential surfaces having tracks (16) which correspond to the channels, wherein the feed conveyors (7, 8, 9) are arranged to feed said lamination pieces through a flexibly adjustable edge sawing machine, and means for controlling and optimizing the width adjustment of said sawing machine based on said gauging result.

2. Apparatus according to claim 1, wherein said longitudinal channels (11) and said tracks (16) in the circumferential surfaces have a same cross section.

3. Apparatus according to claim 1, wherein said longitudinal channels (11) and said tracks (16) have a width of 2-10 mm and a depth of 2-10 mm.

4. Apparatus according to claim 1, wherein the sawing machine is connected by the feed conveyors (7, 8, 9) with a downstream edge strip separator (21).

5. Apparatus according to claim 4, wherein the downstream edge strip separator (21) comprises two to five rows (22) of longitudinal wheels (23) that can be raised and lowered.

6. A method of manufacturing edge glued laminations (19) for the manufacture of edge glued laminated panels from thin timber logs comprising the steps of:

sawing the logs into parallel sections to form pieces of wood;

drying said pieces of wood;

planing said pieces of wood and cutting them longitudinally to form lamination pieces (4);

continuously gauging each of said lamination pieces and feeding each of said lamination pieces in a laterally fixed position between endless feed conveyors (7, 8, 9), through a flexibly adjustable edge sawing machine, the feed conveyors (7, 8, 9) comprising reinforced rubber 5-15 mm thick and resting on idler or drive rollers (12) along an entire length of the feed conveyors and having a number of longitudinal channels (11) on the side remote from the lamination pieces (4), the idler or drive rollers (12) being provided with circumferential surfaces having tracks (16) which correspond to the channels (11);

controlling and optimizing the width adjustment of said edge sawing machine based on said gauging result; and sawing each of said lamination pieces into edge glued laminations (19) of optimum width.

7. The method of manufacturing edge glued laminations according to claim 6, further comprising, after sawing, the endless belts conveying the wood onwards to a downstream edge strip separator (21) where the right-angled edge glued laminations (19) are automatically separated from the trimmed edge strips (18).

8. The method of manufacturing edge glued laminations according to claim 7, wherein the edge glued laminations (19) have different widths.

9. The method of manufacturing edge glued laminations according to claim 6, wherein the edge glued laminations (19) have different widths.

10. The method of manufacturing edge glued laminations according to claim 6, wherein thin timber logs have a top diameter of 80-140 mm.

* * * * *

UNITED STATES PATENT AND TRADEMARK OFFICE

CERTIFICATE OF CORRECTION

PATENT NO. : 8,365,781 B2
APPLICATION NO. : 12/667730
DATED : February 5, 2013
INVENTOR(S) : Lars Stenstrom It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 406 days.

Signed and Sealed this
First Day of September, 2015

Michelle K. Lee

Michelle K. Lee
*Director of the United States Patent and Trademark Office*